US006390748B2

(12) United States Patent
Stolz

(10) Patent No.: US 6,390,748 B2
(45) Date of Patent: May 21, 2002

(54) DEVICE FOR THREADING A BINDING THREAD ALONG A TRANSFER PATH BETWEEN A THREAD SPOOL AND A SEWING NEEDLE

(75) Inventor: Marcel Stolz, Felben-Wellhausen (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/851,011

(22) Filed: May 7, 2001

(30) Foreign Application Priority Data

May 17, 2000 (EP) ..... 00810427

(51) Int. Cl.[7] ..... B42D 2/00
(52) U.S. Cl. ..... 412/35; 412/33; 112/21
(58) Field of Search ..... 412/1, 4, 6, 10, 412/33, 22, 35; 112/21

(56) References Cited

U.S. PATENT DOCUMENTS 3,911,517 A * 10/1975 Davis ..... 156/447
5,248,234 A 9/1993 Hollenstein
5,507,524 A * 4/1996 Botschi et al. ..... 412/35
5,771,825 A 6/1998 Degen et al.

FOREIGN PATENT DOCUMENTS

| | | |
|---|---|---|
| EP | 0537106 | 4/1993 |
| EP | 0665121 | 8/1995 |
| EP | 0603126 | 7/1997 |

* cited by examiner

*Primary Examiner*—Willmon Fridie, Jr.
(74) *Attorney, Agent, or Firm*—Friedrich Kueffner

(57) ABSTRACT

A device for threading a binding thread along a transfer path between a thread spool and a sewing needle of a stitching unit of a thread stitching machine configured for binding a book in sheets at a groove side of the book in sheets has manipulation devices for manipulating the thread along the transfer path. A thread guiding device forming the transfer path is provided and correlated with at least one of the manipulation devices. A compressed air source is connected to the thread guiding device. The thread guiding device performs at least one of the functions of drawing in the thread and transporting the thread in a transport direction by compressed air supplied by the compressed air source.

11 Claims, 2 Drawing Sheets

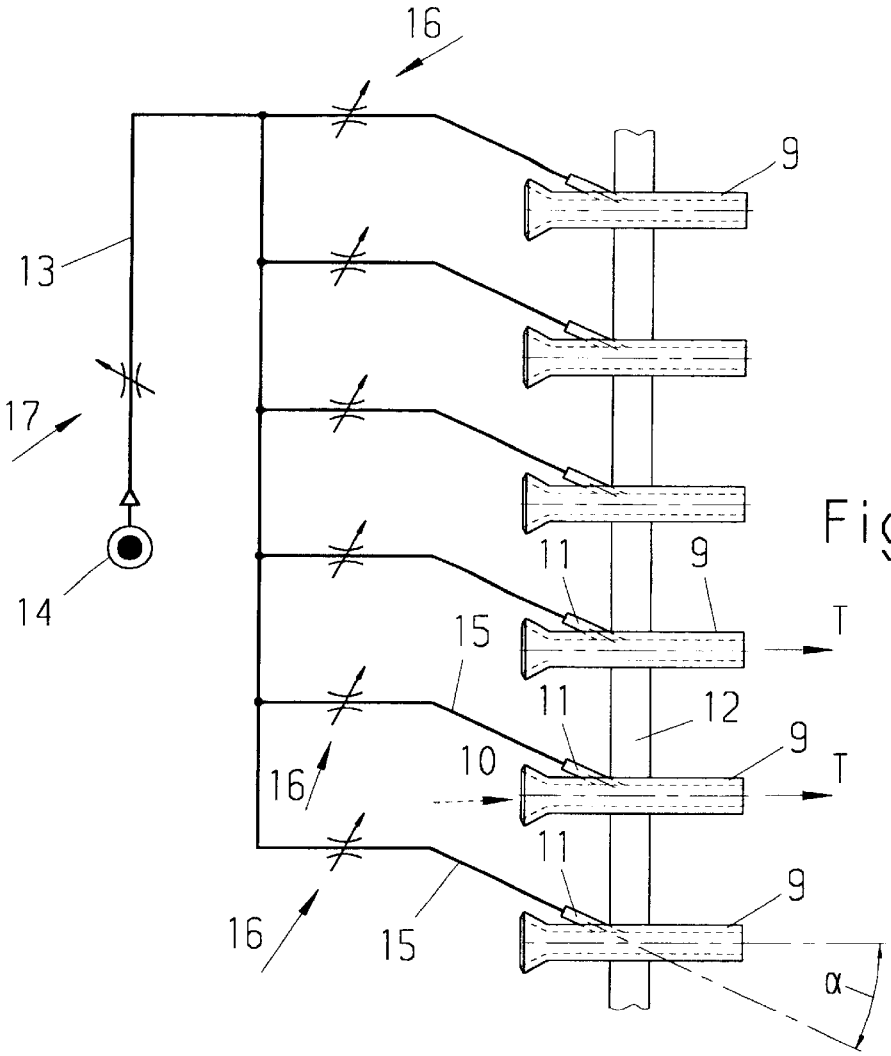
Fig. 3
Fig. 4
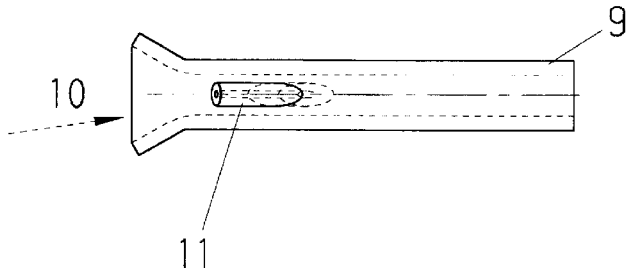

DEVICE FOR THREADING A BINDING THREAD ALONG A TRANSFER PATH BETWEEN A THREAD SPOOL AND A SEWING NEEDLE

BACKGROUND OF THE INVENTION

1. Field of the Invention

The invention relates to a device for threading a binding thread along a transfer path extending between the thread spool and a sewing needle of a stitching unit of a thread stitching machine configured for the binding of books in sheets at the groove side thereof.

2. Description of the Related Art

Thread stitching machines of the aforementioned kind are disclosed, inter alia, in European patent documents 0 537 106, 0 603 126, 0 665 121, 0 832 758 and also in the prior art described therein.

The threading of the binding thread along the transfer path between the thread spool and the sewing needle is realized by manual labor and pincer-like auxiliary instruments across the different manipulation devices for securing the thread along the transfer path, such as, for example, the thread tension device, the thread clip, the thread length compensation device, the thread sensor, the thread tensioner and so on, which make the threading labor more difficult.

SUMMARY OF THE INVENTION

It is an object of the present invention to simplify the threading of the thread and to shorten the threading time along the transfer path and within the stitching unit of the thread stitching machine.

In accordance with the present invention, this is achieved in that the transfer path is formed by a thread guiding device correlated with at least one of the manipulation devices for guiding the binding thread and connectable to a compressed air source for the threading and/or the transport of the binding thread.

By these measures, the threading and the subsequent conveying of the binding thread on the manipulation devices and/or the sewing needles of the corresponding transfer paths is considerably facilitated.

It has been shown to be advantageous when the thread guiding device is formed by a conveying line arranged upstream of the manipulation devices and/or the sewing needle, respectively, into which conveying line at least one compressed air conduit opens which is connected to the compressed air source and positioned at an acute angle in the transport direction relative to the conveying line. This constructive measure is beneficial for the manual process of threading of the binding thread along the transfer path.

Preferably, the conveying line has a widened inlet opening and effects thereby a thread centering and makes the drawing-in action easier.

A further simplification of the threading labor can be realized when the compressed air supply can be changed by a control valve.

In connection with the threading of the binding thread into the conveying lines it is expedient when the compressed air supply to the individual conveying lines is controlled by valves.

When the individual conveying lines have a greater length, it may be expedient when several compressed air conduits are connected thereto which is beneficial with respect to the conveying action.

In a long conveying line with several compressed air conduits it is advantageous when the cross-section of the conveying line widens toward the end of the conveying path.

In the case of a conveying cross-section which tapers in the conveying direction towards the end of the conveying path, the velocity of the conveying medium can be increased.

Since the individual manipulation devices between thread spool and sewing needle can move the binding thread in the operating position into an arbitrary position which is different from the rest position, it is advantageous when the manipulation devices during threading of the binding thread are moveable into a position such that the conveying lines form in the threading or drawing direction at least substantially a straight transfer path.

BRIEF DESCRIPTION OF THE DRAWING

In the drawing:

FIG. 3 is a schematic illustration of conveying lines connected to a compressed air source; and FIG. 4 is a plan view onto an individual conveying line.

DESCRIPTION OF THE PREFERRED EMBODIMENTS

Figure 1:
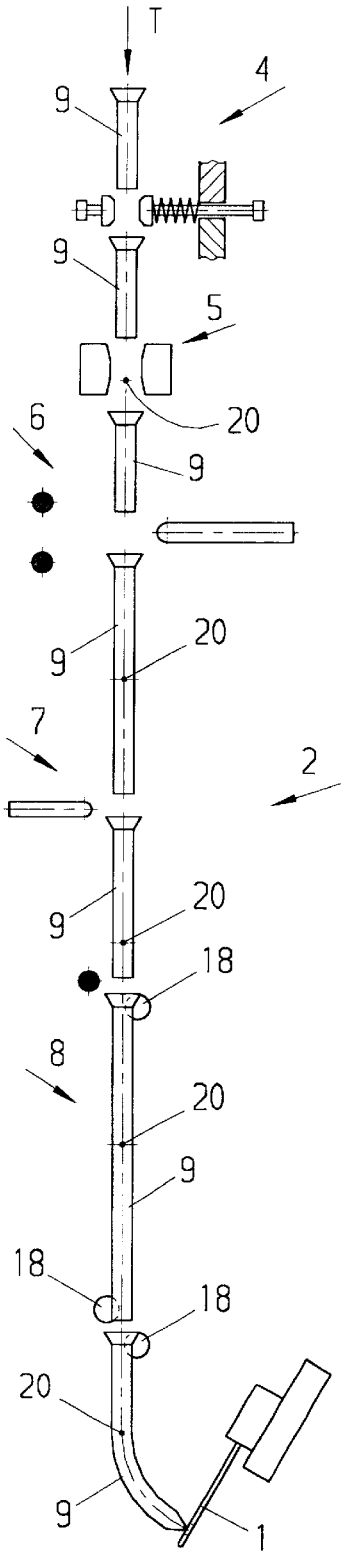
FIG. 1 is a schematic illustration of the transfer path for the binding thread in the drawing-in position.
Figure 2:
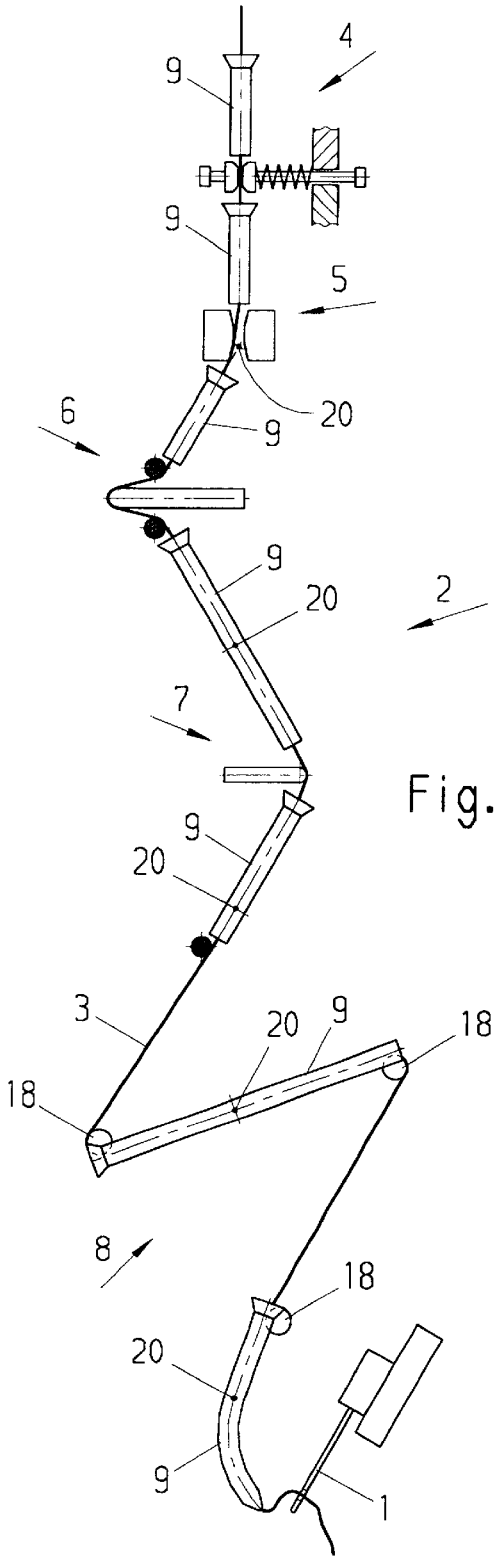
FIG. 2 is a schematic illustration of the transfer path in an operating position.

The FIGS. 1 and 2 show a transfer path 2 between the thread spool (not shown) and a sewing needle 1 of the stitching unit of a thread stitching machine for a binding thread 3 for binding books in sheets, wherein FIG. 1 shows an inoperative position and FIG. 2 shows the operative position of the device according to the invention.

In FIG. 2, a binding thread 3 has been pulled into a transfer path 2 correlated with a stitching unit and extends to the sewing needle 1 which has an eye for threading the binding thread 3. The transfer path 2 has, beginning at the end facing the thread spool, a schematically illustrated thread tension device 4 which prevents the binding thread 3 from continuing to be removed from the thread spool. Downstream of the thread tension device 4 a thread clip 5 is provided which is provided for tensioning the binding thread 3, and downstream thereof a thread length compensating device 6 is provided in order to be able to compensate or correct the desired thread length. Moreover, a thread sensor 7 is provided along the transfer path which monitors the presence of the binding thread 3 within the transfer path 2. Finally, upstream of the sewing needle 1 a thread tensioner 8 is provided which also provides a thread supply for a sewing cycle. All of these manipulation devices 4 to 8 have correlated therewith a conveying line 9, respectively, which is a closed conveying channel and has a widened inlet opening 10 at the side where the thread enters, as illustrated in FIGS. 3 and 4. The binding thread 3 is threaded with its leading end via the inlet opening 10 and from there is further transported by means of compressed air supplied to the conveying line 9 via a connecting socket 11. The connecting sockets 11 which have a smaller conveying cross-section then the conveying line 9 are positioned at an acute angle $\alpha$ relative to the transport direction T, as illustrated in FIGS. 3 and 4. According to FIG. 4, the air supply via the connecting socket 11 is approximately axial to the conveying cross-section of the conveying line 9. The air flow could also be offset relative to the conveying cross-section so that an air flow with twist results. The opening for the compressed air is arranged downstream to the inlet opening 10 of the conveying line and effects before the mouth of the conveying line a vacuum which is beneficial for the conveying action.

FIG. 3 illustrates several adjacently arranged conveying lines 9 mounted on the support 12 of a stitching unit. These conveying lines 9, each being assigned to one of the manipulation devices 4 through 8 of the transfer path 2, for example, the thread length compensation device 6, are connected to the compressed air conduit 13 of the compressed air source 14, wherein each of the conveying lines 9 has correlated therewith a compressed air conduit portion 15 in which a control valve 16 for individual air supply to the correlated conveying line 9 is provided.

Of course, it is also possible to control or approximately uniformly distribute the compressed air coming from the compressed air source 14, with the control valves 16 being open, via the control valve 17 arranged upstream.

FIG. 4 shows also that the conveying-active cross-section of the conveying line 9 tapers increasingly toward the end of the conveying path, but can also widen, in particular, when the conveying line has several connecting sockets 11 for the supplied compressed air. The compressed air supply can also be distributed, with the control valves 16 being open, via the control valve 17 into the conveying lines 9 (see FIG. 3). Referring back to FIGS. 1 and 2, it should be noted that the transfer path 2, as a result of the differently functioning manipulation devices 4 to 8, differs considerably between the threading (drawing-in) position and the operating position. In particular, a considerably changed orientation of the manipulation devices is present so that the conveying lines 9, as a function of the required position changes, must be configured to be location-displaceable and/or position-displaceable. Moreover, it is required that the compressed air conduit 13 and the compressed air conduit portions 15 are realized by hoses which can compensate the movements of the conveying lines 9 when being moved. Of course, the conveying lines 9 can also be curved in their extension and can have at their ends deflecting rollers 18 receiving the binding thread, in particular, where the conveying lines 9 are pivotal about an axis 20.

While specific embodiments of the invention have been shown and described in detail to illustrate the inventive principles, it will be understood that the invention may be embodied otherwise without departing from such principles.

What is claimed is:

1. A device for threading a binding thread along a transfer path between a thread spool and a sewing needle of a stitching unit of a thread stitching machine configured for binding a book in sheets at a groove side of the book in sheets, the device comprising:

manipulation devices configured to manipulate the thread along the transfer path;

a thread guiding device forming the transfer path and correlated with at least one of the manipulation devices;

a compressed air source connected to the thread guiding device;

wherein the thread guiding device is configured to perform at least one of the functions of drawing in the thread and transporting the thread in a transport direction by compressed air supplied by the compressed air source.

2. The device according to claim 1, wherein the thread guiding device is comprised of one or more conveying lines arranged upstream of at least one of the manipulation devices and the sewing needle, respectively, wherein the compressed air source has one or more compressed air conduits connected at an acute angle in the transport direction to the one or more conveying lines, respectively.

3. The device according to claim 2, wherein the compressed air conduit is arranged at the conveying line so as to open laterally offset into the conveying line to generate an air flow with twist.

4. The device according to claim 2, wherein the conveying line has a widening inlet opening.

5. The device according to claim 2, wherein the compressed air device comprises a control valve configured to control the supply of compressed air to the conveying line.

6. The device according to claim 2, wherein the stitching device comprises several needles, wherein each one of the needles has one of the conveying lines connected thereto, wherein the compressed air source has several control valves controlling the supply of compressed air to the conveying lines.

7. The device according to claim 2, wherein several of the compressed air conduits are connected to one of the conveying lines.

8. The device according to claim 7, wherein the conveying line has a transport-effective cross-section widening in the transport direction.

9. The device according to claim 7, wherein the conveying line has a transport-effective cross-section tapering in the transport direction.

10. The device according to claim 2, wherein the thread spool is arranged above the sewing needle, respectively, wherein the manipulation devices are configured to be displaceable when drawing in the thread such that the transfer path formed by the conveying lines in the transport direction is substantially straight.

11. The device according to claim 2, wherein the conveying lines are configured to be displaceable with respect to at least one of their location and their position.

* * * * *